US006162161A

United States Patent [19]

De Stefanis

[11] Patent Number: 6,162,161

[45] Date of Patent: Dec. 19, 2000

[54] SPLITTING MACHINE FOR CORRUGATED BOARD PROFILES

[75] Inventor: Sergio De Stefanis, Alessandria, Italy

[73] Assignee: Texo S.R.L., Spinetta Marengo, Italy

[21] Appl. No.: 09/029,678

[22] PCT Filed: Jul. 1, 1997

[86] PCT No.: PCT/EP97/03427

§ 371 Date: May 12, 1998

§ 102(e) Date: May 12, 1998

[87] PCT Pub. No.: WO98/01269

PCT Pub. Date: Jan. 15, 1998

[30] Foreign Application Priority Data

Jul. 3, 1996 [IT] Italy ..... T096A0567

[51] Int. Cl.[7] ..... B31B 1/16

[52] U.S. Cl. ..... 493/372; 493/74

[58] Field of Search ..... 493/56, 74, 73, 493/82, 83, 340, 342, 372, 373

[56] References Cited

U.S. PATENT DOCUMENTS

| | | | |
|---|---|---|---|
| 2,577,424 | 12/1951 | Luehrs | 93/58 |
| 2,779,257 | 1/1957 | Jedelick | 93/36 |
| 3,949,653 | 4/1976 | Schroter | 93/36 A |
| 4,038,909 | 8/1977 | Preisig | 93/93 M |
| 4,076,114 | 2/1978 | Tokuno | 198/425 |
| 4,790,223 | 12/1988 | Busch | 83/48 |
| 5,054,353 | 10/1991 | Haack et al. | 83/639.5 |
| 5,183,247 | 2/1993 | Blumer | 270/95 |
| 5,312,316 | 5/1994 | Wu | 493/123 |
| 5,337,639 | 8/1994 | Morrison | 83/111 |
| 5,386,753 | 2/1995 | Baron et al. | 83/335 |

FOREIGN PATENT DOCUMENTS

| | | |
|---|---|---|
| 0323097 | 7/1989 | European Pat. Off. . |
| 1589211 | 4/1970 | France . |
| 2325475 | 4/1977 | France . |
| 2424111 | 11/1979 | France . |
| 2158907 | 6/1973 | Germany . |
| 9214557 | 12/1982 | Germany . |

*Primary Examiner*—Joseph J. Hail, III
*Attorney, Agent, or Firm*—Helfgott & Karas, P.C.

[57] ABSTRACT

There is described a splitting machine for corrugated board profiles being moved, this machine comprising advancement mechanism (2, 9) for stacks (4) of cardboard sheets; and a splitting device (11) for the stacks (4) composed of an upper ram (23*a*) and a lower ram (23*b*) with vertical axes that are offset one from the other, that come in contact simultaneously and on opposite sides with surfaces of the stacks (4) to exert thereon the splitting action. The rams (23*a*, 23*b*) are assembled on their respective eccentric shafts (27*a*, 27*b*) and can be divided into a plurality of rams (23*a*′,23*a*″; 23*b*′, 23*b*″) that are mutually offset by 180° along the circumference of the eccentric shafts (27*a*, 27*b*). This splitting machine allows the stacks (4) to never stop along the movement line and allows splitting profiles with a particular shape.

11 Claims, 4 Drawing Sheets

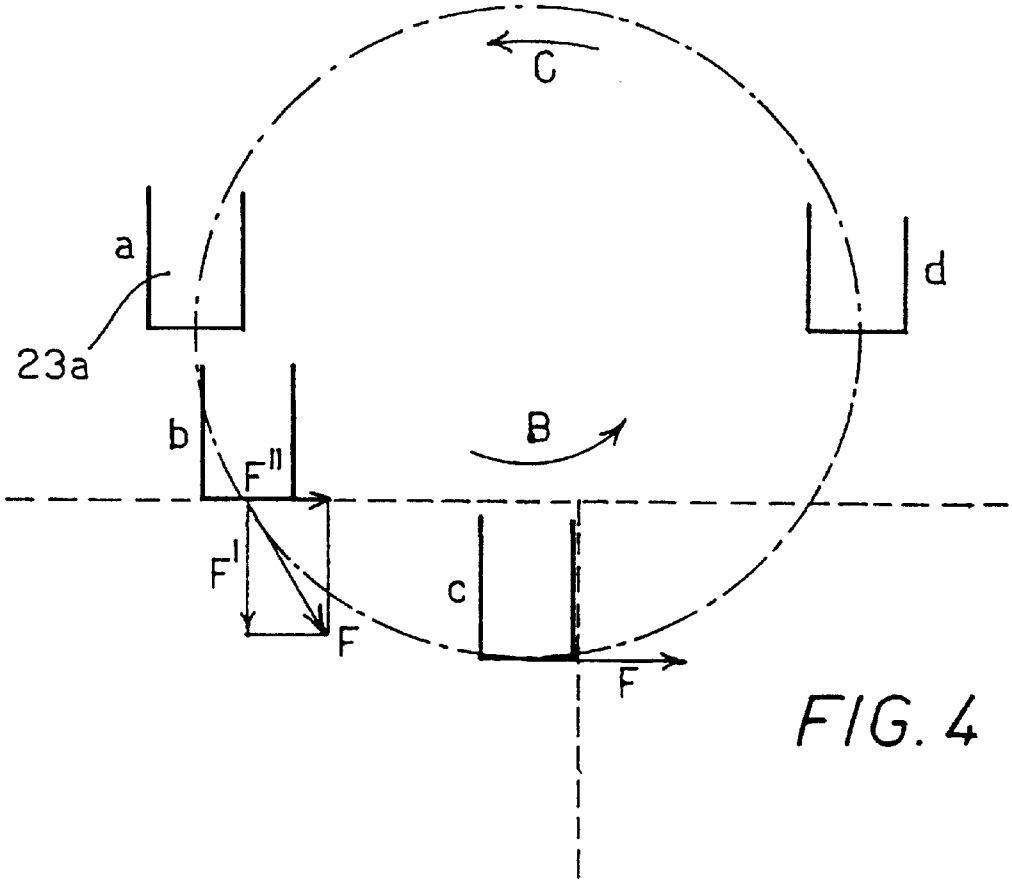
FIG. 4
FIG. 5
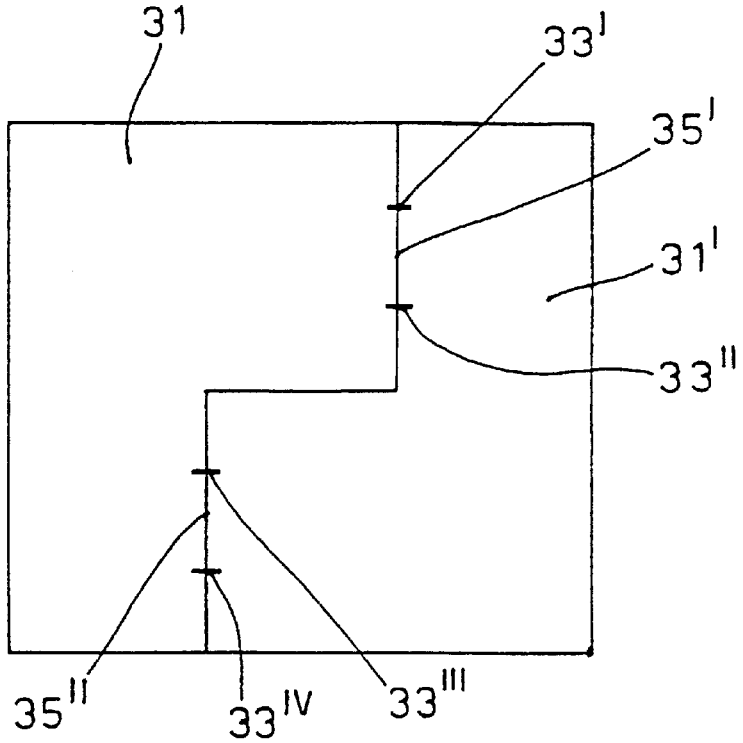

SPLITTING MACHINE FOR CORRUGATED BOARD PROFILES

FIELD OF THE INVENTION

The present invention refers to a splitting machine for sheet materials and in particular to a splitting machine for corrugated board profiles.

BACKGROUND OF THE INVENTION

Corrugated board profiles for packagings, at the end of the various working steps and before being palletized and afterwards shipped, can appear under the shape of moving stacks usually composed of 20÷40 corrugated board sheets. Each one of these sheets can be composed of a plurality of elementary profiles, already die-cut into their final shape, but kept together by a plurality of junction points, these points having been obtained by suitably profiling the hollow punches when die-cutting. Since working is at the end, it is necessary in this step to separate the different stacks of elementary profiles one from the other, by breaking these junction points.

In order to carry out such splitting operation, two major types of splitting machines are known in the art. The first type is the object of document EP-A-0 404 909, that discloses a splitting machine for profiles provided with the following features: (a) the stacks of profiles to be splitted come to the splitting station and stop there; (b) the stacks are blocked between a pair of small presses; (c) splitting occurs through a breakage due to two following traction actions along the sheet advancement direction. This splitting machine needs several operating steps and the procedure is long, being because it is necessary to stop the advancing stacks, lock them, split them, unlock them and make them start again: this machine is therefore scarcely suitable for workings where a high production throughput per time unit is required.

The second type of splitting machine is commercially available from the Pallmac company and provides a hinged and rotating device that splits the stacks by exerting thereon a force from the top downwards while it is kept rotating. This splitting machine too, though needing a lower splitting pressure with respect to the previous one, requires an even longer operating time than the first machine, because it is necessary to stop the advancing stacks, lock them, rotate the splitting device, take back the device to a rest position, unlock the stacks and make them start again.

Moreover, all types of prior art splitting machines exert the splitting action on a single line that is perpendicular to the stack advancement direction; it is therefore impossible to separate stacks composed of profiles of a particular shape (for example "L"-shaped and "inverted L"-shaped) that are kept joined together for practical purposes and for production efficiency. For this reason, the stacks must be manually splitted at the end of all workings.

SUMMARY OF THE INVENTION

Object of the present invention therefore is solving the above prior art problems, providing a splitting machine that splits stacks of corrugated board profiles while they are moving and without having to stop them, practically without adding working steps apart from the splitting operation itself.

A further object of the present invention is exerting a splitting action by means of a splitting device of the "ram" type, but with an efficient and relatively low splitting force.

Another object of the present invention is being able to "decompose" the splitting device into two parts that are offset by 180° one from the other in order to be able to split stacks of profiles with particular shapes, joined together through junction lines that are located on two straight lines that are perpendicular to the stack advancement direction.

Through these arrangements, the splitting machine for corrugated board profiles of the present invention allows high stack advancement speeds and therefore high production throughputs per time unit, and guarantees an efficient splitting between stacks of profiles that are both very high and with particular shapes, being suitable for all types of workings required by modern packaging industries.

The above and other objects and advantages of the invention, which will appear from the following description, are obtained with a splitting machine for corrugated board profiles as claimed in claim 1. Preferred embodiments and non-trivial variations of the present invention are claimed in claims 2 to 10.

BRIEF DESCRIPTION OF THE DRAWINGS

The present invention will be better described by some preferred embodiments thereof, given as a non-limiting example, with reference to the enclosed drawings, in which:

FIG. 4 As an enlarged view that shows the operation of one of the rams of the splitting device of the invention; and FIG. 5 is a top view of a cardboard sheet with particular profiles that can be splitted by means of the splitting machine of the present invention.

DETAILED DESCRIPTION OF THE INVENTION

Figure 1:
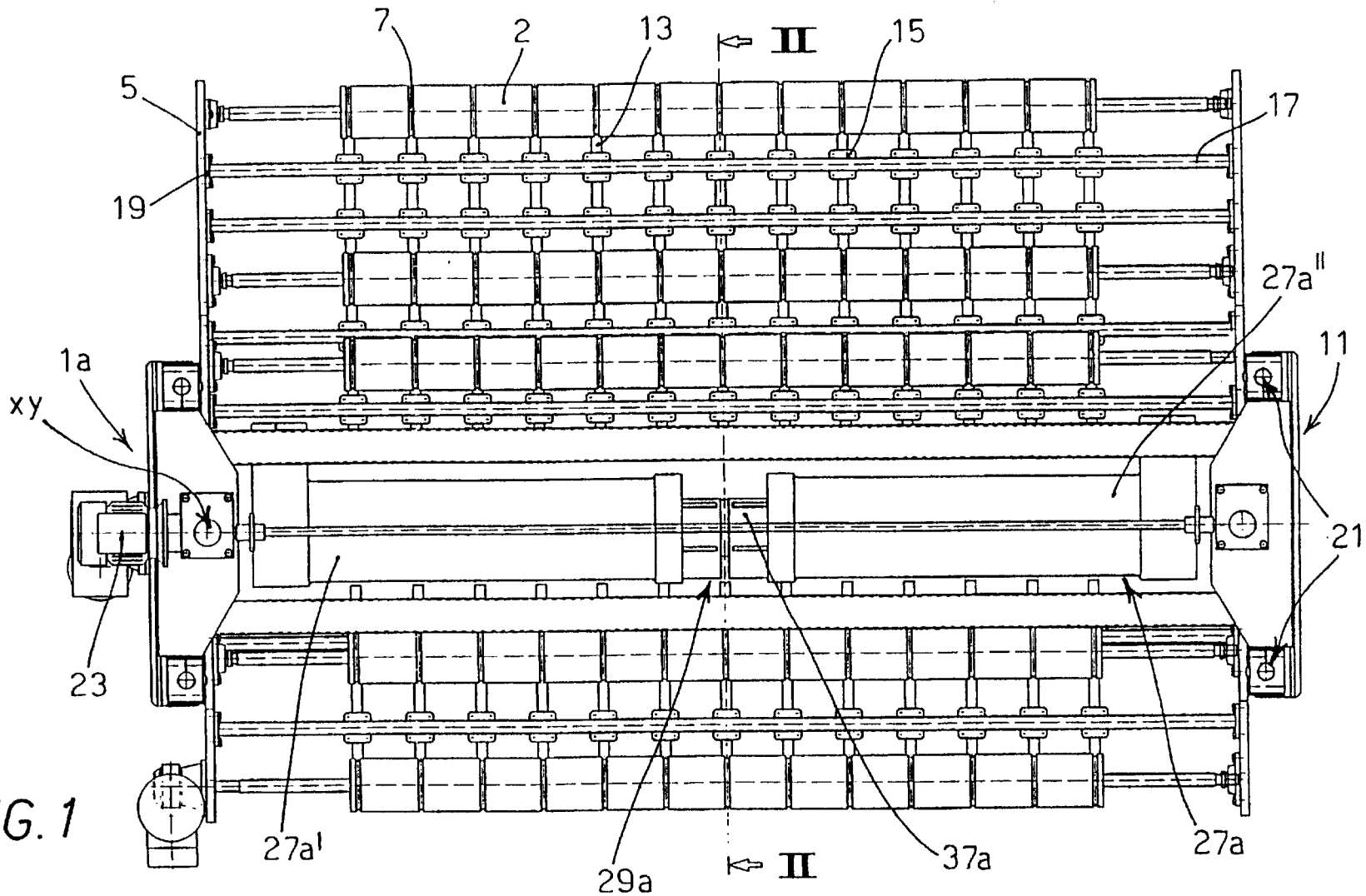
FIG. 1 is a top view of an embodiment of the splitting machine according to the present invention.
Figure 2:
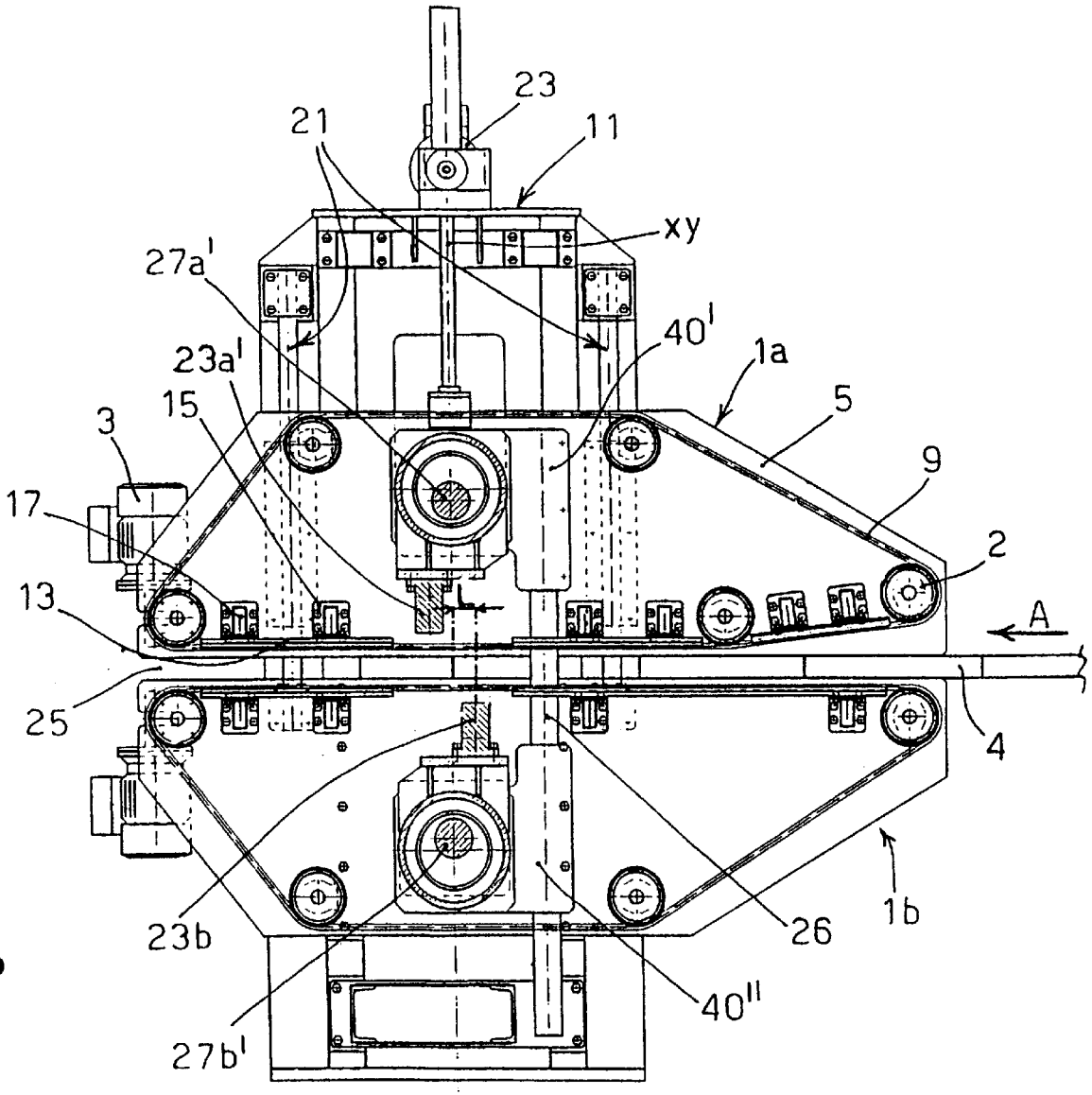
FIG. 2 is a partially sectioned, side view carried out along the section line II—II in FIG. 1.
Figure 3:
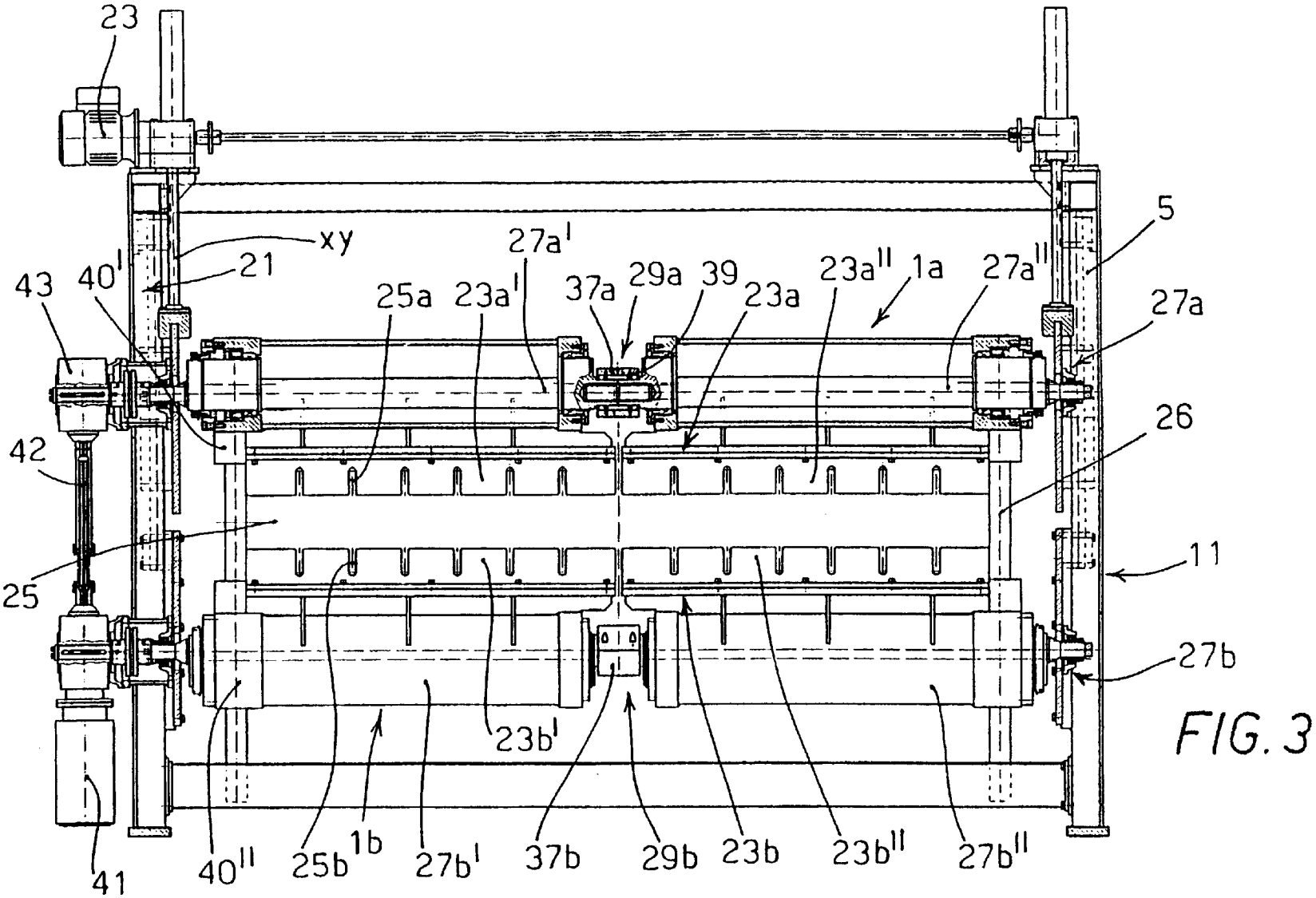
FIG. 3 is a partially sectioned, front view of the splitting machine in FIG. 1.

With reference to FIGS. 1 to 3, the splitting machine for corrugated board profiles of the present invention is composed of an upper part 1*a* and a lower part 1*b*, that are practically identical, and that therefore will be described only with respect, where possible, to the upper part 1*a*. In both parts 1*a*, 1*b* a plurality of rollers 2 are provided, driven by a motor 3 (for example equipped with an inverter to modify the speed according to the type of treated material), to make the stacks 4 of corrugated board profiles advance. Each one of the rollers 2 is rotatingly connected to a support structure 5 and is equipped with a plurality of grooves 7, each one of said grooves 7 being suitable to receive a belt 9: the belts 9 engage the stacks 4 and push them advancing for example along the direction of arrow A in FIG. 2. As already mentioned, the stacks 4 are never stopped and are splitted, i.e., separated one from the other when their junction lines come next to the splitting device 11, that will be described below.

The advancement belts 9 are guided by a plurality of bearing sticks 13 connected through adequate supports 15 to a plurality of rods 17, in turn secured by means of bearings 19 to the structure 2. While each one of the sticks 13 follows the path of the belts 9, the rods 17 are inserted between the rollers 2, in order to form a structure of the reticular type to support/move the stacks 4, as is best shown in FIG. 1.

The upper part 1*a* of the splitting machine is connected to a support pillar 21; while the lower part 1*b* is secured to the structure 5, the upper part 1*a* can vertically slide along such pillar 21, said part 1*a* being moved by a motor 23 through the screw XY, in order to be able to adjust the height of the gap 25 between the two parts 1*a*, 1*b* to make different types of stacks 4 pass between them.

In an approximately central position with respect to the splitting machine of the present invention, the splitting device 11 proper is located, that is best shown in FIGS. 2 and 3.

The splitting device 11 is supported instead by a pillar 26 and reciprocates along the moving direction A of the stacks 4. The splitting device 11 is composed of an upper ram 23*a* and a lower ram 23*b* whose shape is substantially of elongated, thick blades spanning all possible width of the stacks 4. The rams 23*a* and 23*b* are further formed in order to obtain therein a plurality of respective grooves 25*a* and 25*b*, through which the advancement belts 9 pass when splitting the stacks 4.

According to the preferred embodiment shown in FIGS. 1 to 3, moreover, each one of the rams 23*a* and 23*b* is in turn divided into two rams 23*a*′, 23*a*″ and 23*b*′, 23*b*", for a better splitting flexibility, as will be better described below. It is obviously possible to realize the rams 23*a* and 23*b* both into a single elongated piece, and into three or more elementary pieces according to working needs.

Each one of the rams 23*a*′, 23*a*″ and 23*b*′, 23*b*″ is connected to a respective eccentric shaft 27*a*′, 27*a*′ and 27*b*′, 27*b*″, whose rotation movement allows lowering the rams 23*a*′, 23*a*″ and 23*b*′, 23*b*″ in contact with the moving stacks 4 and then lifting them to take them back into a waiting position for the following operation, as is better seen in FIG. 4 and as will be described below.

The eccentric shafts 27*a*′, 27*a*″ and 27*b*′, 27*b*″ are joined together in pairs through the devices 29*a* and 29*b* to form respective complete shafts 27*a* and 27*b*. This division has been realized in order to mutually "offset" by 180° (with respect to the circumference of the shafts 27*a* and 27*b*) the rams 23*a*′ and 23*a*″ and the rams 23*b*′ and 23*b*″, in order to be able to split the cardboard sheets shaped as an "L" or an "inverted L", as shown in FIG. 5, where the profiles 31, 31' are joined together, for example, by means of the junction points $\mathbf{33}^{I}$, $\mathbf{33}^{II}$, $\mathbf{33}^{III}$ and $\mathbf{33}^{IV}$ along the contact lines 35' and 35", that are mutually offset. Splitting of this type of profiles was impossible automatically by means of the prior art splitting machines, and it was even more unfeasible with moving stacks 4.

The devices 29*a* and 29*b* are essentially composed of respective sleeves 37*a* and 37*b* that can be opened, and that are secured through common clamp pins 39 to the eccentric shafts 27*a*′, 27*a*″ and 27*b*′, 27*b*″, after having mutually adjusted the rams 23*a*′, 23*a*″ and 23*b*′, 23*b*″ so that they are thereby phased or mutually offset by 180°.

As clearly appears from FIG. 2 in a very enlarged way for an easy view, the axes of the rams 23*a* and 23*b*, in an operating position, are mutually offset with respect to the plane of the paper by the distance 2L, where L is the distance between the axis of a ram and the junction line between one stack and the other. This distance, that is currently of the order of few mm and can get, in a non-limiting way, to a maximum of about 50 mm, allows, when both rams 23*a* and 23*b* are pushed against the stacks 4 (the ram 23*a* from the top downwards and the ram 23*b* from the bottom upwards), exerting a "torsion" pressure along the junction line between one stack and the other and therefore effectively splitting them. This offset arrangement of the rams 23*a* and 23*b* further allows pushing them against the stacks for a small depth (equal to about 10% of the total height of the stack 4, for example about 15 mm) that is anyway enough to detach and split the stacks.

The two upper and lower blocks of reducing shafts/rams are connected to the pillar 26 by means of respective brackets 40' and 40": while the bracket 40' of the upper block is fixedly connected to the pillar 26, the bracket 40" of the lower block is vertically-movingly connected to the pillar 26.

In order to allow the movement of the eccentric shafts 27*a*', 27*a*″ and 27*b*′, 27*b*″, a ratio-motor 41 is provided, connected to the structure 5 and coupled in 42 to a reduction unit, in order to synchronize the rotating movement of all shafts 27*a*′, 27*a*″ and 27*b*′, 27*b*″ and consequently the movement of the rams 23*a*′, 23*a*″ and 23*b*′, 23*b*″. Therefore, when operating, the rams 23*a*′, 23*a*″ and 23*b*′, 23*b*″ will be moved with an eccentric rotating motion upwards and downwards, and with a translatory motion due to the fact that, through the connection to the pillar 26, they are constrained not to be able to have a relative rotation. Therefore, sliding of the lower block along the pillar 26 allows the "anti-rotation" of the splitting device 11.

Through the splitting machine of the present invention it is currently possible to split stacks composed of a number of cardboard sheets going from 20 to 40, according to the type of material used, for a global thickness approximately equal to 10÷20 cm. Obviously, the splitting machine is configured in order to be easily calibrated for different production needs, and the above-mentioned values must not be intended as limiting for the field of application of the present invention.

The operation of the splitting machine for profiles according to the present invention will now be described, with particular reference to FIG. 4, where the movement of the upper ram 23*a* is shown as an example.

At the beginning of the operation, the ram 23*a* is in the starting position a: the splitting machine, through a sensor (not shown) located at the beginning of the path, detects the passage of the junction line between the stacks and, due to the fixed data (related to distance between splitting machine inlet and splitting device 11, length of the stacks 4, number of sheet packs to be splitted, etc.) that the machine has, drives the rotation of the belts 9 and controls this rotation for example through an encoder (not shown) located on a roller 2 of the belts 9. Thus the stacks 4 advance and simultaneously the rotation of the eccentric shafts 27*a*′, 27*a*″ and 27*b*′, 27*b*″ is activated and the ram 23*a*, for example, starts descending towards the stack moving plane along the direction B in FIG. 4. Upon contact with the stacks 4 in position b, the ram 23*a* exerts a strong pressure downwards (given by the vertical component F' of the speed vector F in point b), while the horizontal component F" of the vector F, that represents the advancement of the ram 23*a* along a direction that is parallel to the stack advancement one, is still lower than the stack speed: thereby, in position b, the ram 23*a* exerts a sufficient splitting pressure without sliding along the stack surface.

Position c is then reached (shown in FIG. 4 in an exaggeratedly enlarged way for an easy view) where the pressure depth is at a maximum, wherein the vector F is wholly a speed vector, and the speed is identical to the stack advancement one. After that, the ram 23*a* is lifted till it reaches position d, the end-of-work position, and then it is taken back, by rotating it along direction C in FIG. 3, to the starting position a: the repositioning path from d to a can be followed at a high speed or at such a speed as to make the ram 23*a* come to position a when this is necessary for the following splitting position.

Due to the splitting machine of the present invention, it is possible to realize a very quick, complete working cycle for cardboard sheets, even at the expense of the perfect alignment of the sheets in each stack after having been splitted. In fact, due to the presence of aligning devices (not shown) downstream of the splitting machine itself, it is not necessary that the outgoing sheets are perfectly paired, since they will be aligned afterwards: it is enough that the sheets remain stacked, even if slightly mutually offset, and this result is easily obtained by the splitting machine of the present invention.

Some embodiments of the invention have been described, but obviously they are prone to further modifications and variations within the same inventive idea. For example, while the rams 23*a*′, 23*a*″ and 23*b*′, 23*b*″ have been shown with a rectangular shape (FIG. 3), they can be realized with a slanting contact side (of the guillotine-blade type), or with a triangular shape, or with any other shape that is suitable to-exert a sufficient splitting force.

What is claimed is:

1. Splitting machine for corrugated board profiles comprising:

advancement means (2,9) for stacks (4) of cardboard sheets, and a splitting device (11) for said stacks (4), said stacks (4) of cardboard sheets are always moving through said splitting machine along their operating movement line wherein said splitting device (11) is composed of an upper ram (23*a*) and a lower ram (23*b*) whose respective vertical movement axes are offset one from the other, parallel to one another and perpendicular to the stack advancement direction, said upper and lower rams (23*a*, 23*b*) coming in contact simultaneously and on opposite sides with surfaces of said stacks (4) pushing against the stacks only into a partial depth of the stacks on each side respectively, to exert thereon a splitting action.

2. Splitting machine for corrugated board profiles according to claim 1, wherein each one of said upper and lower rams (23*a*, 23*b*) is secured to a respective eccentric shaft (27*a*, 27*b*) to perform a vertical movement of said rams (23*a*, 23*b*) and a simultaneous movement along the advancement direction of the stacks (4).

3. Splitting machine for corrugated board profiles according to claim 1, wherein each one of said upper and lower rams (23*a*, 23*b*) is composed of a plurality of rams (23*a*′, 23*a*″; 23*b*′, 23*b*″) respectively mutually offset by 180° along a circumference of said eccentric shafts (27*a*, 27*b*), first ones (23*a*′; 23*b*′) of said plurality of rams (23*a*′, 23*a*″; 23*b*′, 23*b*″) coming in contact with the stacks (4) at a time and a position that are different with respect to other ones (23*a*″; 23*b*″) of said plurality of rams (23*a*′, 23*a*″ and 23*b*′, 23*b*″).

4. Splitting machine for corrugated board profiles according to claim 1, wherein a peripheral speed of said rams (23*a*′, 23*a*″; 23*b*′, 23*b*″) is equal to the advancement speed of the stack (4).

5. Splitting machine for corrugated board profiles according to claim 1, wherein said upper ram (23*a*) is fixedly connected to a support pillar (26) and said lower ram (23*b*) is vertically-movably connected to said pillar (26), said pillar (26) being provided with a rotatory and translatory motion that is equal to the one of the upper ram (23*a*).

6. Splitting machine for corrugated board profiles according to claim 1, wherein the 180° offset between said rams (23*a*′, 23*a*″ and 23*b*′, 23*b*″) is realized by means of devices (29*a*, 29*b*) that join together the parts (27*a*′, 27*a*″; 27*b*′, 27*b*″) of said eccentric shafts (27*a*, 27*b*), said devices (29*a*, 29*b*) being composed of sleeves (37*a*, 37*b*) and clamp pins (39).

7. Splitting machine for corrugated board profiles according to claim 1, wherein said rams (23*a*′, 23*a*″; 23*b*′, 23*b*″) include a plurality of grooves (25*a*, 25*b*) through which a plurality of advancement belts (9) for the stack (4) pass when said rams (23*a*′, 23*a*″; 23*b*′, 23*b*″) are undertaking a splitting operation.

8. Splitting machine for corrugated board profiles according to claim 1, characterized in that said rams (23*a*′, 23*a*″; 23*b*′, 23*b*″) are of an elongated rectangular shape.

9. Splitting machine for corrugated board profiles according to claim 1, wherein said rams (23*a*′, 23*a*″; 23*b*′, 23*b*″) have a side thereof that carries out the splitting operation that is slanted with respect to the stack (4) surface.

10. Splitting machine for corrugated board profiles according claim 1, wherein said rams (23*a*′, 23*a*″; 23*b*′, 23*b*″) are of a triangular shape on one side and of a complementary shape with respect to the triangular one on an opposite side.

11. Splitting machines for corrugated board profiles according to claim 1, wherein said depth is approximately 10% of a height of said stacks on each side, respectively.

* * * * *